US007645248B2

(12) United States Patent
Brown

(10) Patent No.: US 7,645,248 B2
(45) Date of Patent: Jan. 12, 2010

(54) WALL-MOUNTED BACK MASSAGER INCLUDING WHEELS

(76) Inventor: Luke Brown, 115 W. Galer St., #101, Seattle, WA (US) 98109

( * ) Notice: Subject to any disclaimer, the term of this patent is extended or adjusted under 35 U.S.C. 154(b) by 606 days.

(21) Appl. No.: 11/611,322

(22) Filed: Dec. 15, 2006

(65) Prior Publication Data

US 2008/0146979 A1 Jun. 19, 2008

(51) Int. Cl.
*A61H 15/00* (2006.01)

(52) U.S. Cl. ..... 601/122; 601/128

(58) Field of Classification Search ..... 601/97–103, 601/115, 116, 118, 119, 122, 123, 125, 128, 601/129, 130, 131, 134, 135
See application file for complete search history.

(56) References Cited

U.S. PATENT DOCUMENTS

| | | | | |
|---|---|---|---|---|
| 1,572,794 | A * | 2/1926 | Hamilton | 606/240 |
| 1,833,426 | A * | 11/1931 | Knudson | 606/240 |
| 4,374,519 | A * | 2/1983 | Stauft | 601/128 |
| 4,416,271 | A * | 11/1983 | Chester | 601/118 |
| 5,174,282 | A | 12/1992 | Bleggi | |
| 5,634,887 | A * | 6/1997 | Fortier | 601/115 |
| 6,808,500 | B1 | 10/2004 | Chen-Yi et al. | |
| 6,832,991 | B1 | 12/2004 | Inada et al. | |
| 7,014,620 | B2 | 3/2006 | Kim | |
| 7,081,098 | B2 | 7/2006 | Kim | |
| 7,087,004 | B1 * | 8/2006 | Berke | 482/136 |
| 2002/0013541 | A1 | 1/2002 | Marcantoni | |
| 2002/0193715 | A1 | 12/2002 | Slack | |
| 2005/0148912 | A1 | 7/2005 | Liao | |

* cited by examiner

*Primary Examiner*—Danton DeMille
(74) *Attorney, Agent, or Firm*—Thomas E. Loop

(57) ABSTRACT

A wall-mounted back massager adapted to allow a user to self-administer a massage is disclosed. The inventive wall-mounted back massager comprises: an elongated wall mount track vertically positioned on a wall; a vertically adjustable elongated base member slidably engaged to the wall mount track; a plurality of swivel head assemblies attached in series along the elongated base member; and at least first and second pairs of spaced apart and axially aligned wheels rotatably attached to each of the plurality of swivel head assemblies by respective first and second wheel axles. Each swivel head assembly is pivotably between first and second swivel head positions. In this configuration, vertical movement of a person's back due to bending and straightening of their knees effects movement of the swivel head assemblies and attached wheels relative to the person's back, thereby allowing the person to enjoy a self-administered massage.

5 Claims, 4 Drawing Sheets

WALL-MOUNTED BACK MASSAGER INCLUDING WHEELS

TECHNICAL FIELD

The present invention relates generally to therapeutic massaging devices, and more particularly, to wall-mounted back massagers.

BACKGROUND OF INVENTION

As is appreciated by physical therapists, massage involves the manipulation of muscle and connective tissue to enhance the function of those tissues and promote relaxation and well-being. Therapeutic massage can ease tension and reduce pain, and can also be highly effective for reducing the symptoms of arthritis, back pain, and other disorders of the muscles and/or nervous system. Massage is generally administered either by another person (such as, for example, a masseuse or a masseur) or is self-administered by means of a mechanical massaging device.

Over the years, a variety of massaging devices have been invented and marketed to those desirous of self-administered massage. Exemplary in this regard are the various massage contraptions disclosed in following U.S. patents and patent publications:

U.S. Pat. No. 5,174,282 to Bleggi discloses a back massage apparatus for use by a user while in a standing position on a floor in close proximate relation to a fixed vertical surface. The back massage apparatus comprises a plurality of spaced elastomeric balls (for alternately applying and releasing pressure on the back muscles of the user) rotatably supported by a carrier system that is attached to the fixed vertical surface. The balls are positioned between the user's back and the vertical surface with the balls orientated on opposite sides of the spinal column. Vertical movement of the user's back due to bending of the knees effects movement of the balls relative to the user's back.

U.S. Patent Application No. U.S. 2002/0013541 to Marcantoni discloses a massaging device (to be inserted in the back of a massage chair or the like) that comprises a frame suitable to support massage wheels which are rotationally actuated by at least one gearmotor. The massage wheels are directly connected to the shaft of the gearmotor by way of an element suitable to produce an oscillation of the massage wheels so that the longitudinal axis of the massage wheels oscillates, during the rotation of the wheels, with respect to the axis that passes through the center of the wheels.

U.S. Patent Application No. US2002/0193715 to Slack discloses a wall-mounted back massager that comprises a stationary hardwood ball vertically positioned at a user selected height. The user is thus able to press and move their back against the ball, and is doing is able to apply therapeutic pressure to relieve back, shoulder and neck tension.

U.S. Pat. No. 6,808,500 to Cheng-Yi et al. discloses a roller massager that comprises a seat body, a drive motor, a sliding seat, a second drive motor and rocker arm Ape massaging roller sets. The massaging roller sets are pivoted at the ends of a drive rod and is driven by the second drive motor indirectly, which is characterized by two pilot end heads eccentrically fitted at the two ends of the drive rod respectively, while a pilot end head at one end is provided with a radial slot, together with a bolt installed on the drive rod, that pilot end head can rotate itself depending on the different rotating directions of the drive rod, thus change the relative attitude to the pilot end head at another end. In this configuration, the roller sets call achieve motions of rising and sinking, as well as automatic switching between two massaging modes of rocking and kneading.

U.S. Pat. No. 6,832,991 to Inada et al. discloses a massaging apparatus in which the position of a specific portion of a user's body (such as a user's shoulder) with respect to the massaging apparatus can be determined automatically and accurately in a simple construction. The massaging apparatus includes a supporting arm having a therapeutic member pivotally supported thereon and freely movable along the user's body. The position of the specific portion of the user's body with respect to the massaging apparatus is determined from the relation between the vertical position of the supporting arm and the pivotal position of the supporting arm. A pivotal movement detecting system is provided that detects when the supporting arm reaches a prescribed range of pivotal movement.

U.S. Patent Publication No. 2005/0148912 to Liao discloses a massaging wheel assembly that comprises two base frames pivotally connected in parallel to a sliding carrier slidably movable in a sliding track, each base frame having a wheel axle at the front end and a pivot pin at the rear end, two supplementary frames respectively pivoted to the pivot pins at the rear ends of the base frames, each supplementary frame having two wheel axles at the ends, two main massaging wheels respectively pivoted to the wheel axles at the front ends of the base frames, and four supplementary massaging wheels respectively pivoted to the wheel axles at the ends of the supplementary frames.

U.S. Pat. No. 7,014,620 to Kim discloses a lie-down massager that comprises a frame having an elongated top panel with an elongated opening, a rider below the top panel, a guide member movably engaged between the frame and the rider to enable the rider to make a horizontal reciprocation relative to the frame, a lifter moving vertically relative to the rider, and a roller gear engaged to the rider. The roller gear is engaged to a vertical rack gear in an opening of an engagement body extending from the lifter so the roller gear rotation enables the lifter to make a vertical reciprocation. Massage bumps attached to the top portion of the lifter move vertically and/or horizontally along the elongated top opening of the elongated top panel of the frame by the lifter and the rider.

U.S. Pat. No. 7,081,098 to Kim discloses a lie-down massager that comprises a base frame having a top panel, a rider provided below the top panel of the base frame, a guide member movably engaged between the base frame and the rider to enable the rider to make a horizontally reciprocal movement relative to the base frame, massage bumps that move vertically along an elongated top opening of the elongated top panel of the base frame, and a litter that holds the massage bumps and adjusts the height of the massage bumps. The lifter includes a top plate, a bottom plate, a fluid operated cylinder fixed to the bottom plate, and a spring fixed between the top plate and the bottom plate. The fluid operated cylinder has a cylinder shaft that is moved by pressurized fluid overcoming the force of the spring, and a guide shaft and a guide bearing that have a square cross section.

Although a vast variety of self-administered back massagers are known to exist, there is still a need in the art for new and improved back massagers, especially in terms of back massagers that have reduced size, bulkiness, cumbersomeness, and cost. There is also a need ill the art for new and improved back massagers that are gearless and motorless. There is still a further need in the art for back massagers that are readily attachable to a fixed vertical surface, and are readily adjustable to a user selected height. The present invention fulfills these needs and provides for further related advantages.

SUMMARY OF THE INVENTION

In brief, the present invention is directed to a wall-mounted back massager adapted to allow a user to self-administer a massage. The inventive wall-mounted back massager comprises: an elongated wall mount track vertically positioned on a wall; a vertically adjustable elongated base member slidably engaged to the wall mount track, a plurality of swivel head assemblies attached in series along the elongated base member; and at least first and second pairs of spaced apart and axially aligned wheels rotatably attached to each of the plurality of swivel head assemblies by respective first and second wheel axles. In this embodiment, each swivel head assembly is pivotably attached to the base member by a respective swivel head axle positioned along a respective swivel head axis of rotation, with each swivel head axis of rotation being substantially perpendicular to the lengthwise direction of the elongated base member. The first and second wheel axles of each swivel head assembly are positioned along respective first and second wheel pair axes of rotation, with each wheel pair axis of rotation being substantially perpendicular to the lengthwise direction of the elongated base member and substantially parallel to swivel head axes of rotation. In addition, each swivel head assembly is pivotably between first and second swivel head positions defined such that (i) the first wheel pair axle contacts the base member and the second wheel pair axle extends away from the base member when the swivel head assembly is in the first position, and (ii) the first wheel pair axle extends away from the base member and the second wheel pair axle contacts the base member when the swivel head assembly is in the second position.

In a further embodiment, the wall mount track may further comprise an outwardly protruding rail positioned lengthwise along the wall mount track; and the base member may further comprise an inwardly protruding channel positioned lengthwise along the base member. In this further embodiment, the inwardly protruding channel is configured to slidably engage the outwardly protruding rail. The inwardly protruding channel may, for example, be U-shaped in cross-section. Finally, each of the plurality of swivel head assemblies may further comprise a pair of spaced apart and confronting first and second swivel head plates, wherein the elongated base member is positioned such that (i) the elongated base member is in between and adjacent to each pair of first and second swivel head plates, and (ii) each pair of first and second swivel head plates is in between and adjacent to the respective first and second pair of wheels of each of the plurality of swivel head assemblies.

These and other aspects of the present invention will become more evident upon reference to the following detailed description and attached drawings. It is to be understood, however, that various changes, alterations, and substitutions may be made to the specific embodiments disclosed herein without departing from their essential spirit and scope. Finally, it is expressly provided that all of the various references cited herein are incorporated herein by reference in their entireties for all purposes.

BRIEF DESCRIPTION OF THE DRAWINGS

The drawings are intended to be illustrative and symbolic representations of certain exemplary embodiments of the present invention and as such they are not necessarily drawn to scale. In addition, and for purposes of clarity, like reference numerals have been used to designate like features throughout the several views of the drawings.

DETAILED DESCRIPTION OF THE INVENTION

Figure 1:
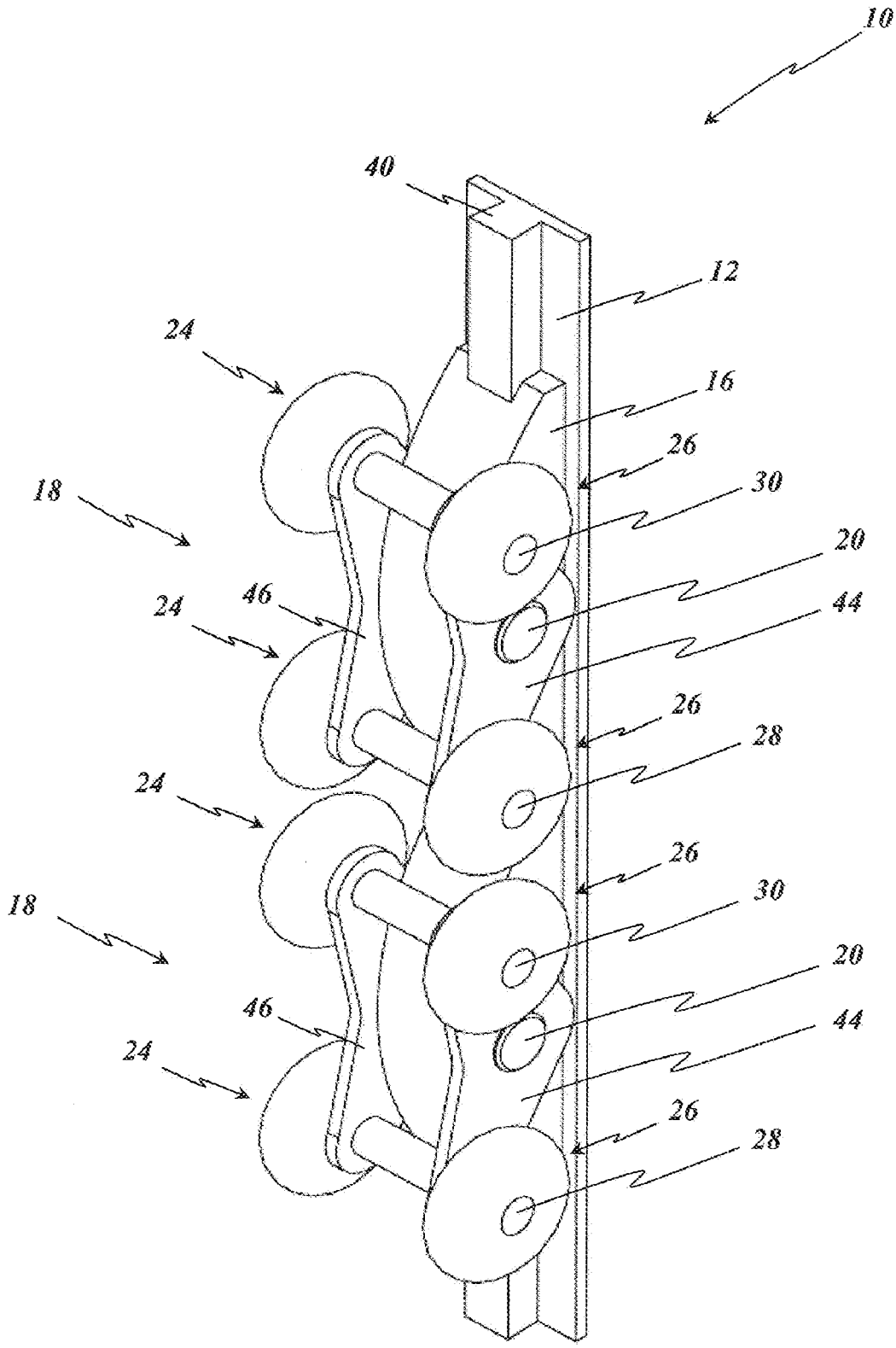
FIG. 1 shows an isometric view of a wall-mounted back massager in accordance with an embodiment of the present invention.
Figure 2:
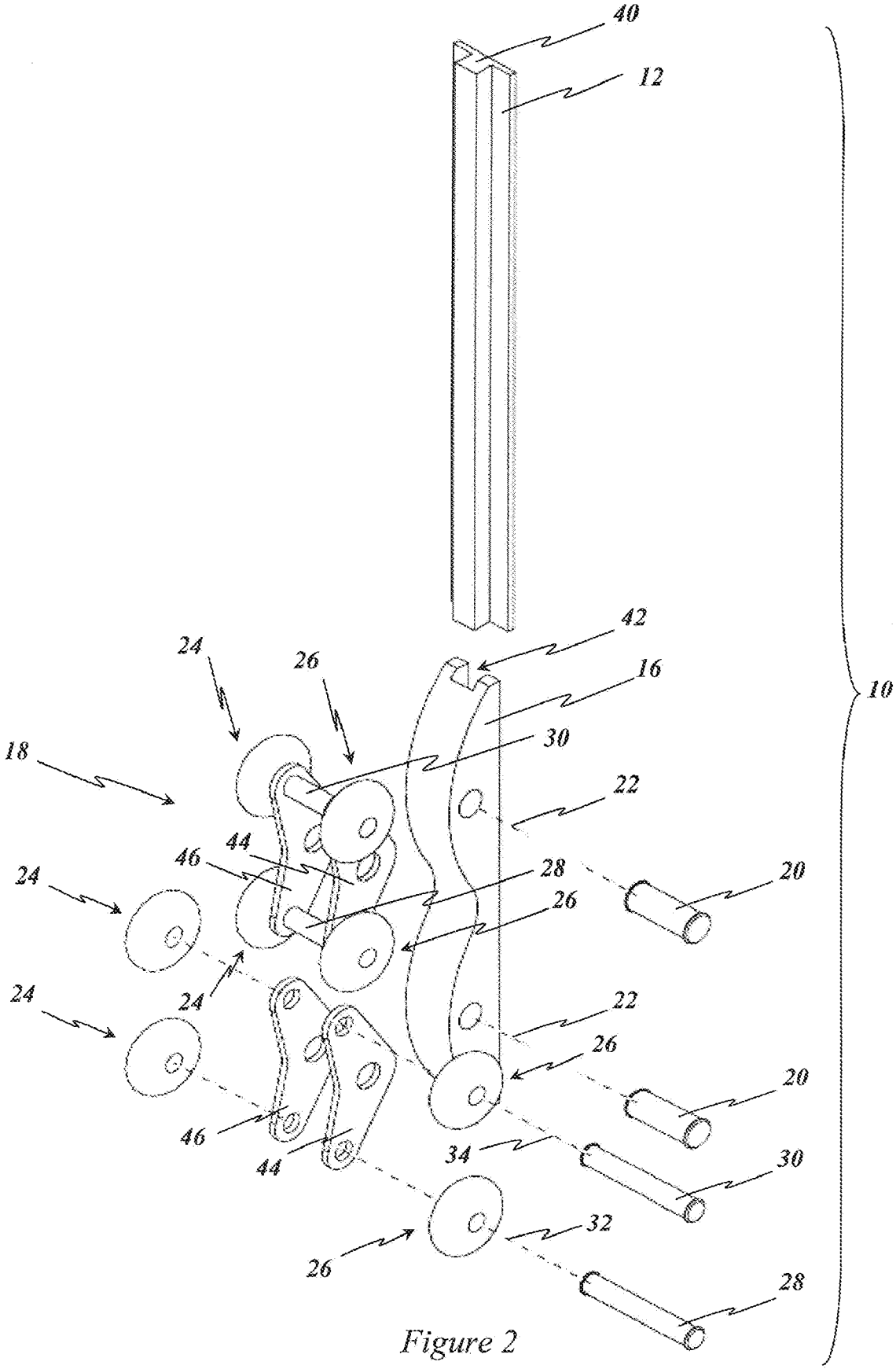
FIG. 2 shows an exploded view of the wall-mounted back massager of FIG. 1.
Figure 3B:
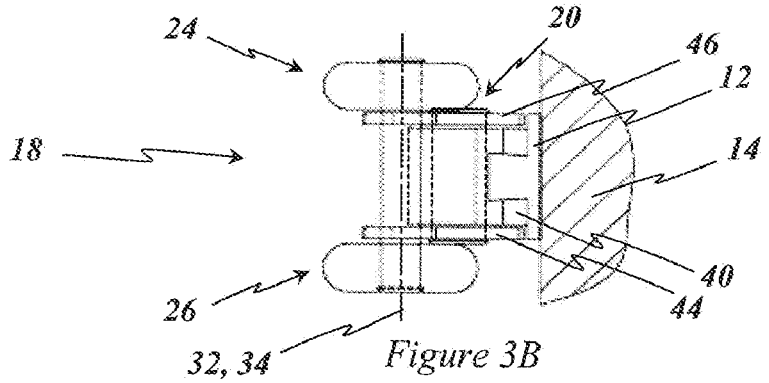
FIG. 3B shows a top end view of the wall-mounted back massager of FIGS. 1, 2, and 3A.
Figure 3A:
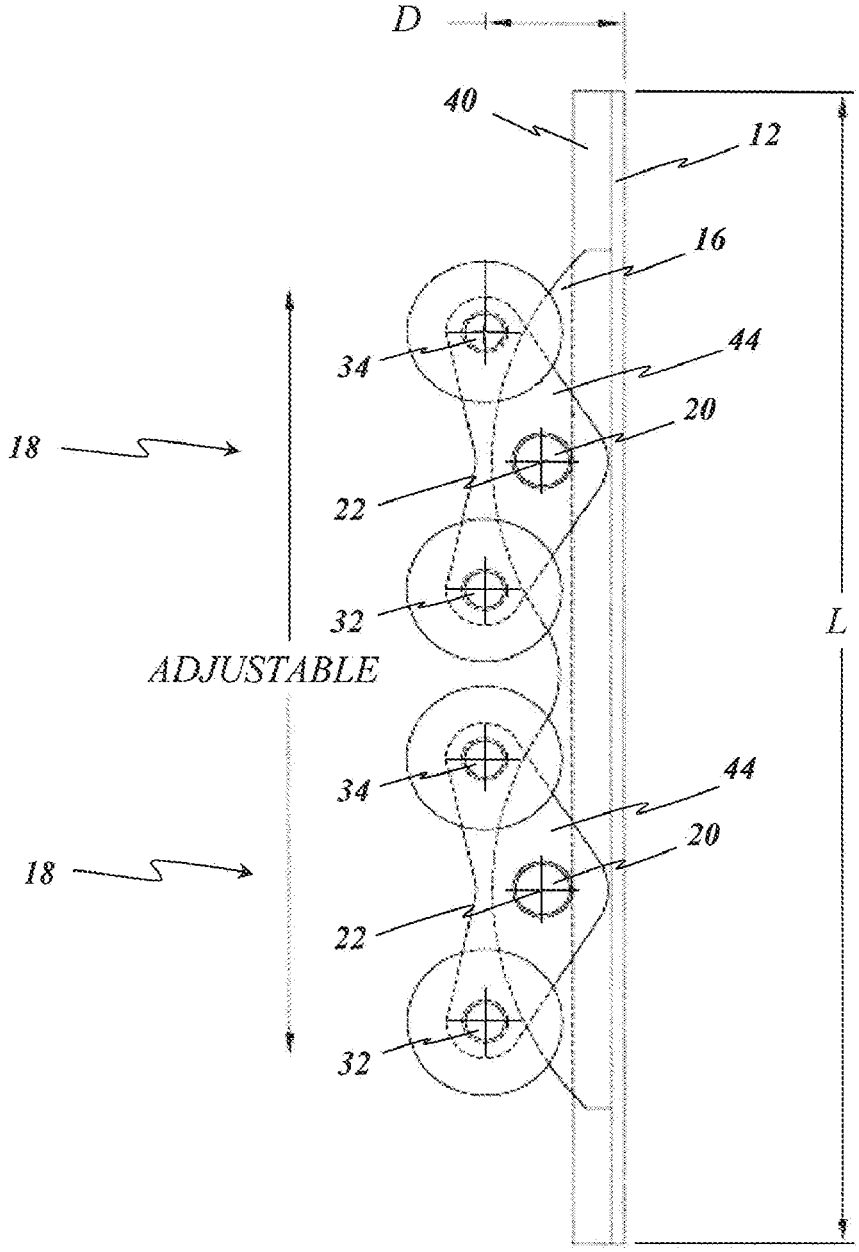
FIG. 3A shows a side elevational view of the wall-mounted back massager of FIGS. 1 and 2.
Figures 4A, 4B:
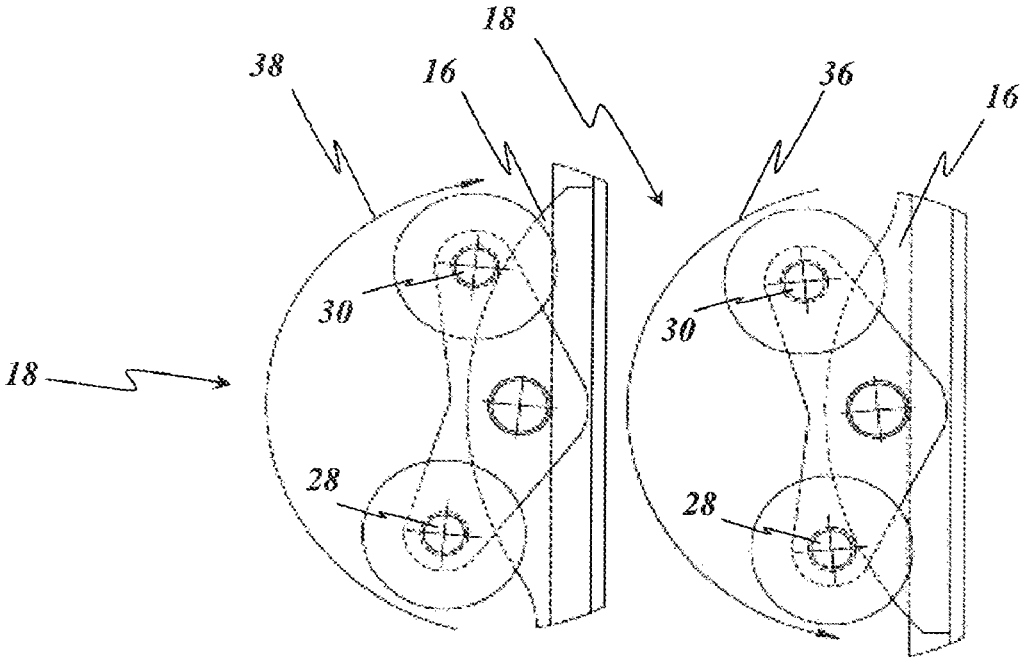
FIG. 4A shows a side elevational view of a discrete swivel head assembly ill accordance with the embodiment of the present invention shown in FIGS. 1, 2, 3A and 3B, wherein the swivel head assembly is in a first position.
FIG. 4B shows a side elevational view of the discrete swivel head assembly of FIG. 4A, wherein the swivel head assembly is in a second position.
Figures 5A, 5B:
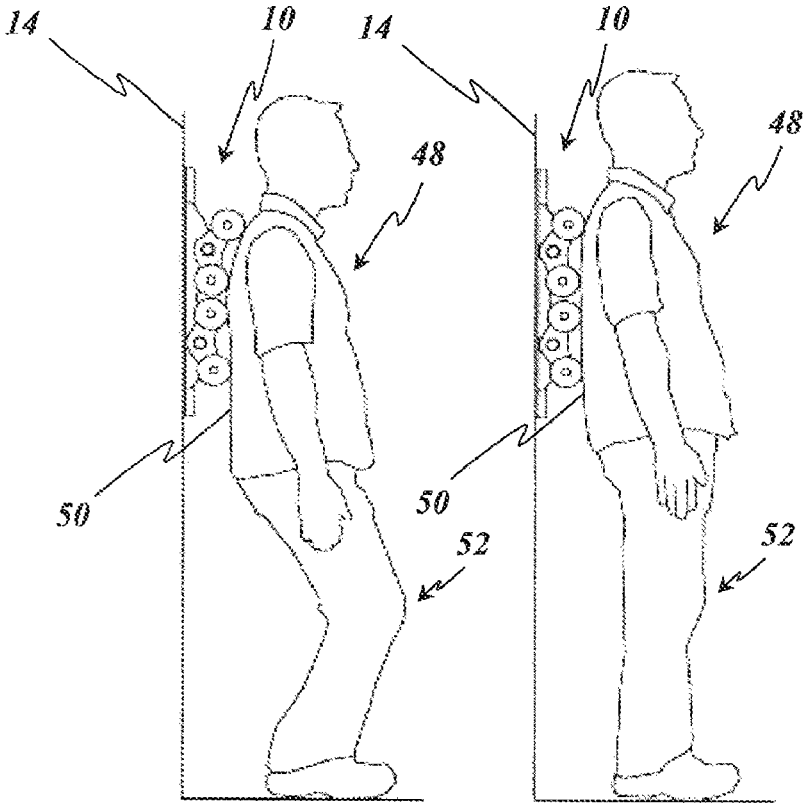
FIG. 5A shows a side elevational view of the wall-mounted back massager of FIGS. 1, 2, 3A, 3B, 4A and 4B, wherein a person is using the wall-mounted back massager in a partially squatted upright position.
FIG. 5B shows a side elevational view of the wall-mounted back massager of FIG. 5B, wherein the person is using the wall-mounted back massager in a fully upright position.

Referring now to the drawings wherein like reference numerals designate identical or corresponding elements, and more particularly to FIGS. 1, 2, 3A, 3B, 4A, 4B, 5A and 5B, the present invention is directed to a wall-mounted back massager 10 that comprises an elongated wall mount track 12 vertically positioned on a wall 14 (as shown in FIGS. 3B, 5A and 5B); a vertically adjustable elongated base member 16 slidably engaged to the wall mount track 12 (vertically adjustable by means of one or more conventional stop pills, tension screws, or wing nut configuration—not shown); and a plurality of swivel head assemblies 18 attached in series along the elongated base member 16. As best shown in FIG. 2, each swivel head assembly 18 is pivotably attached to the base member 16 by a respective swivel head axle 20 positioned along a respective swivel head axis of rotation 22. As shown, each swivel head axis of rotation 22 is substantially perpendicular to the lengthwise direction of the elongated base member 16.

The inventive wall-mounted back massager 10 further comprises at least first and second pairs of spaced apart and axially aligned wheels 24, 26 rotatably attached to each of the plurality of swivel head assemblies 18 by respective first and second wheel axles 28, 30. The first and second wheel axles 28, 30 of each swivel head assembly 18 are positioned along respective first and second wheel pair axes of rotation 32, 34. Each wheel pair axis of rotation 32, 34 is substantially perpendicular to the lengthwise direction of the elongated base member 16 and substantially parallel to swivel head axes of rotation 22.

As best shown in FIGS. 4A and 4B, respectively, each swivel head assembly 18 is pivotably between first and second swivel head positions 36, 38 defined such that (i) the first wheel pair axle 28 contacts the base member 16 and the second wheel pair axle 30 extends away from the base member 16 when the swivel head assembly 18 is in the first position 36, and (ii) the first wheel pair axle 28 extends away from the base member 16 and the second wheel pair axle 30 contacts the base member 16 when the swivel head assembly 18 is in the second position 38. In either position (as well as in any position therebetween), the wheels 24, 26 attached to respective ends of the first and second wheel axles 28, 30 are freely rotatable.

As best shown in FIGS. 1, 2, 3A and 3B, the wall mount track 12 of the inventive wall-mounted back massager 10 may further comprise an outwardly protruding rail 40 positioned lengthwise along the wall mount track 12, and the base member 16 may further comprise an inwardly protruding channel 42 (shown in FIG. 2) positioned lengthwise along the base member 16. In this configuration, the inwardly protruding channel 42 is adapted to slidably engage the outwardly protruding rail 40. As shown the inwardly protruding channel 42 may, for example, be U-shaped in cross-section while the outwardly protruding rail 40 is correspondingly inverted U-shaped in cross-section. Finally, and as best shown in FIGS. 2 and 3B, each of the plurality of swivel head assemblies 18 may further comprise a pair of spaced apart and confronting first and second swivel head plates 44, 46. As shown, the elongated base member 16 is positioned such that (i) the elongated base member 16 is in between and adjacent to each pair of first and second swivel head plates 44, 46, and (ii) each pair of first and second swivel head plates 44, 46 is in between and adjacent to the respective first and second pair of wheels 24, 26 of each of the plurality of swivel head assemblies 18.

In a preferred embodiment and as best shown in FIGS. 3A and 3B, the wail mount track 12 of the inventive wall-mounted back massager 10 has a length L of about 24 inches; each of wheels 24, 26 has a diameter of about 3 inches; and the first and second wheel pair axes of rotation 32, 34 are positioned a distance D of about $2^{11}/_{16}$ inches away from the wall 14, when the respective swivel head assembly 18 is half-way between the first and second swivel head positions 36, 38. The wall mount track 12 and base member 16 may be made of a hard wood, but are preferably made of a rigid plastic such as, for example, a polyethylene or a polycarbonate. The wall mount track 12 is generally attached to the wall 14 by means of one or more fasteners (not shown) such as, for example, screws or rivets; however, it may be attached by means of an adhesive. The swivel head plates 44, 46, the swivel head axles 20, and the first and second wheel axles 28, 30 are all preferably made of metal, but may be made of wood (such as, for example, wood dowel). Finally, the wheels 24, 26 are preferably doughnut-shaped and made of a rubber or a hard wood; however, they may be spherical and may be made of another rigid material such as plastic or metal.

In view of the foregoing, it is readily apparent that the inventive wall-mounted back massager 10 may be used by a person 48 standing in close proximity thereto (meaning the person's back 50 is in contact with the rotatably wheels 24, 26 of the pivotably swivel head assemblies 18). More specifically, and as best shown in FIGS. 5A and 5B, vertical movement of the person's back 50 due to bending and straightening of the knees 52 (while leaning against the wall-mounted back massager 10) effects movement of each of the swivel head assemblies 18 and of each of the wheels 24, 26, thereby providing the person 48 with a self-administered massage.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing descriptions, and all changes that come within the meaning and range of equivalency of the claims are to be embraced within their scope.

What is claimed is:

1. A wall-mounted back massager, comprising:

an elongated wall mount track vertically positioned on a wall:

a vertically adjustable elongated base member slidably engaged to the wall mount, track;

a plurality of swivel head assemblies attached in series along the elongated base member, wherein each swivel head assembly is pivotably attached to the base member by a respective swivel head axle positioned along a respective swivel head axis of rotation, and wherein each swivel head axis of rotation is substantially perpendicular to the lengthwise direction of the elongated base member; and at least first and second pairs of spaced apart and axially aligned wheels rotatably attached to each of the plurality of swivel head assemblies by respective first and second wheel axles, wherein the first and second wheel axles of each swivel head assembly are positioned along respective first and second wheel pair axes of rotation, wherein each wheel pair axis of rotation is substantially perpendicular to the lengthwise direction of the elongated base member and substantially parallel to swivel head axes of rotation, and wherein each swivel head assembly is pivotably between first and second swivel head positions defined such that (i) the first wheel pair axle contacts the base member and the second wheel pair axle extends away from the base member when the swivel head assembly is in the first position, and (ii) the first wheel pair axle extends away from the base member and the second wheel pair axle contacts the base member when the swivel head assembly is in the second position.

2. The wall-mounted back massager of claim 1 wherein the wall mount track further comprises an outwardly protruding rail positioned lengthwise along the wall mount track, and wherein the base member further comprises an inwardly protruding channel positioned lengthwise along the base member, and wherein the inwardly protruding channel is configured to slidably engage the outwardly protruding rail.

3. The wall-mounted back massager of claim 2 wherein the inwardly protruding channel is U-shaped.

4. The wall-mounted back massager of claim 2 wherein each of the plurality of swivel head assemblies further comprises a pair of spaced apart and confronting first and second swivel head plates, and wherein the elongated base member is positioned such that (i) the elongated base member is in between and adjacent to each pair of first and second swivel head plates, and (ii) each pair of first and second swivel head plates is in between and adjacent to the respective first and second pair of wheels of each of the plurality of swivel head assemblies.

5. The wall-mounted back massager of claim 4 wherein the back massager is gearless and motorless.

* * * * *

UNITED STATES PATENT AND TRADEMARK OFFICE

CERTIFICATE OF CORRECTION

PATENT NO. : 7,645,248 B2
APPLICATION NO. : 11/611322
DATED : January 12, 2010
INVENTOR(S) : Luke Brown It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 634 days.

Signed and Sealed this

Twenty-first Day of December, 2010

David J. Kappos

David J. Kappos
*Director of the United States Patent and Trademark Office*